US011434112B2

(12) United States Patent
Hayashi

(10) Patent No.: US 11,434,112 B2
(45) Date of Patent: Sep. 6, 2022

(54) CRANE

(71) Applicant: TADANO LTD., Kagawa (JP)

(72) Inventor: Hiroyuki Hayashi, Kagawa (JP)

(73) Assignee: TADANO LTD., Kagawa (JP)

( * ) Notice: Subject to any disclaimer, the term of this patent is extended or adjusted under 35 U.S.C. 154(b) by 10 days.

(21) Appl. No.: 16/977,004

(22) PCT Filed: Mar. 8, 2019

(86) PCT No.: PCT/JP2019/009295
§ 371 (c)(1),
(2) Date: Aug. 31, 2020

(87) PCT Pub. No.: WO2019/172416
PCT Pub. Date: Sep. 12, 2019

(65) Prior Publication Data

US 2021/0002105 A1 Jan. 7, 2021

(30) Foreign Application Priority Data

Mar. 9, 2018 (JP) ..... JP2018-043257

(51) Int. Cl.
*B66C 13/48* (2006.01)
*B66C 13/44* (2006.01)
(Continued)

(52) U.S. Cl.
CPC ..... *B66C 13/48* (2013.01); *B66C 13/44* (2013.01); *B66C 23/905* (2013.01); *B66C 13/40* (2013.01);
(Continued)

(58) Field of Classification Search
CPC ..... B66C 13/44; B66C 13/48; B66C 23/905; B66C 2700/082; B66C 2700/084; B66C 23/00; B66C 23/82; B66C 23/88
See application file for complete search history.

(56) References Cited

U.S. PATENT DOCUMENTS 4,368,824 A * 1/1983 Thomasson ..... B66C 23/905 212/278
4,600,353 A * 7/1986 Phillips, Jr. ..... B60P 3/125 280/402
(Continued)

FOREIGN PATENT DOCUMENTS

CN 1177333 A 3/1998
EP 0812797 A1 12/1997
(Continued)

OTHER PUBLICATIONS

Machine Translation of JP 2017/030634A. (Foreign Reference previously provided by Applicant). (Year: 2017).*
(Continued)

*Primary Examiner* — Michael R Mansen
*Assistant Examiner* — Juan J Campos, Jr.
(74) *Attorney, Agent, or Firm* — Paratus Law Group, PLLC

(57) ABSTRACT

Provided is a crane (1) including: a boom (7); a wire rope (8); a winch (9); and a hook (10). The crane further includes: a spooling operation instrument (24) for enabling commanding an operation state of the winch (9); and switches (switch (41) or switch (42)) for enabling commanding a switch of a control mode with regard to the operation of the spooling operation instrument (24). When the boom (7) is in a flat travel orientation with the hook (10) loaded on a prescribed site (hook platform (12)), the switches ((41), (42)) being in an on state and the spooling operation instrument (24) being operated toward one side thereof cause the boom (7) to be raised to a work orientation while the wire rope (8) is unwound such that the hook (10) is not lifted.

8 Claims, 11 Drawing Sheets

(51) Int. Cl.
*B66C 23/90* (2006.01)
*B66C 13/40* (2006.01)
*B66C 23/36* (2006.01)

(52) U.S. Cl.
CPC ..... *B66C 23/36* (2013.01); *B66C 2700/0371* (2013.01); *B66C 2700/082* (2013.01); *B66C 2700/084* (2013.01)

(56) References Cited

U.S. PATENT DOCUMENTS 8,813,981 B2 * 8/2014 Ethington ..... B66C 23/90 212/281
2007/0089925 A1 * 4/2007 Addleman ..... B66D 1/46 180/313
2008/0019815 A1 * 1/2008 Harris ..... B66C 23/80 414/563
2008/0038106 A1 * 2/2008 Spain ..... B66C 23/80 414/563
2012/0199543 A1 * 8/2012 Bell ..... B66C 23/64 212/299
2012/0199544 A1 * 8/2012 Aus ..... B66C 23/64 212/299

FOREIGN PATENT DOCUMENTS

JP 2011190069 A * 9/2011 ..... B66C 23/88
JP 2017-030634 A 2/2017
JP 2017-122003 A 7/2017

OTHER PUBLICATIONS

Machine Translation of JP 2017/122003A. (Foreign Reference previously provided by Applicant). (Year: 2017).*
Machine Translation of JP 2011/190069A (Year: 2011).*
CN 1177333A Machine Translation. (Year: 1998).*
Apr. 23, 2019, International Search Report issued for PCT application No. PCT/JP2019/009295.
Apr. 23, 2019, International Search Opinion issued for PCT application No. PCT/JP2019/009295.
Jan. 19, 2022, European Search Report issued for related EP Application No. 19764684.7.

* cited by examiner

CRANE

CROSS REFERENCE TO PRIOR APPLICATION

This application is a National Stage Patent Application of PCT International Patent Application No. PCT/JP2019/009295 (filed on Mar. 8, 2019) under 35 U.S.C. § 371, which claims priority to Japanese Patent Application No. 2018-043257 (filed on Mar. 9, 2018), which are all hereby incorporated by reference in their entirety.

TECHNICAL FIELD

The present invention relates to cranes. More specifically, the present invention relates to a crane which achieves improvement in manipulability and safety.

BACKGROUND ART

Conventionally, a crane, which is a typical work vehicle, has been known (see Patent Literature (hereinafter referred to as "PTL") 1). The crane is mainly composed of a traveling body and a swiveling body. The traveling body is provided with a plurality of wheels and is configured to travel freely. The swiveling body is provided with a boom, a wire rope, a winch, and a hook, and is configured to carry a load freely.

Meanwhile, such a crane travels in a posture in which the boom is luffed down, or performs carriage work in a posture in which the boom is luffed up (see PTL 2). Here, the posture in which the boom is luffed down is defined as "traveling posture" and the posture in which the boom is luffed up is defined as "working posture." In transition from the traveling posture to the working posture, it is necessary to luff up the boom while appropriately unwinding the wire rope to prevent the hook from swinging because of being hoisted from a predetermined place such as a hook base. On the other hand, in transition from the working posture to the traveling posture, it is necessary to luff down the boom while appropriately winding the wire rope, with the hook being placed in advance in the predetermined place such as the hook base, to prevent the wire rope from slackening. However, there has been a problem that the manipulation of luffing up the boom while unwinding the wire rope and the manipulation of luffing down the boom while winding the wire rope are complicated and difficult. Moreover, there has also been another problem that the swinging hook collides with the traveling body or the like and the slack wire rope comes off a sheave or the like. Hence, a crane which achieves improvement in manipulability and safety has been required.

CITATION LIST

Patent Literature

PTL 1
Japanese Patent Application Laid-Open No. 2017-122003
PTL 2
Japanese Patent Application Laid-Open No. 2017-30634

SUMMARY OF INVENTION

Technical Problem

A crane which achieves improvement in manipulability and safety is provided.

Solution to Problem

The crane of the present invention is a crane provided with a boom, a wire rope, a winch, and a hook, the boom being capable of being luffed up and down, extended, and retracted, the wire rope being configured to hang from the boom, the winch being configured to wind or unwind the wire rope, the hook being configured to be raised or lowered by the wire rope wound or unwound, the crane including:

a winding manipulation tool that allows giving an instruction on an operating state of the winch; and a switch that allows giving an instruction for switchover of a control mode for manipulation of the winding manipulation tool, in which it is preferable that, when the switch is set to an "ON" state and the winding manipulation tool is manipulated to one side in a traveling posture in which the hook is placed in a predetermined place and the boom is luffed down, the boom is luffed up to adopt a working posture while the wire rope is unwound to prevent the hook from being hoisted.

In the crane of the present invention, a luffing-up speed of the boom is changed in accordance with a manipulation amount of the winding manipulation tool manipulated by an operator.

In the crane of the present invention, a luffing-up speed of the boom is maintained constant regardless of a manipulation amount of the winding manipulation tool manipulated by an operator.

In the crane of the present invention, when the boom is luffed up to a predetermined angle, unwinding operation of the winch for unwinding the wire rope stops at the same time as luffing-up operation of the boom stops.

The crane of the present invention is a crane provided with a boom, a wire rope, a winch, and a hook, the boom being capable of being luffed up and down, extended, and retracted, the wire rope being configured to hang from the boom, the winch being configured to wind or unwind the wire rope, the hook being configured to be raised or lowered by the wire rope wound or unwound, the crane including:

a winding manipulation tool that allows giving an instruction on an operating state of the winch; and a switch that allows giving an instruction for switchover of a control mode for manipulation of the winding manipulation tool, in which it is preferable that, when the switch is set to an "ON" state and the winding manipulation tool is manipulated to an other side in a working posture in which the hook is placed in a predetermined place and the boom is luffed up, the boom is luffed down to adopt a traveling posture while the wire rope is wound to prevent the wire rope from slackening.

In the crane of the present invention, a luffing-down speed of the boom is changed in accordance with a manipulation amount of the winding manipulation tool manipulated by an operator.

In the crane of the present invention, a luffing-down speed of the boom is maintained constant regardless of a manipulation amount of the winding manipulation tool manipulated by an operator.

In the crane of the present invention, when the boom is luffed down to a predetermined angle, winding operation of the winch for winding the wire rope stops at the same time as lulling-down operation of the boom stops.

Advantageous Effects of Invention

According to the crane of the present invention, the crane includes the winding manipulation tool that allows giving an instruction on the operating state of the winch, and the switch that allows giving an instruction for switchover of the control mode for the manipulation of the winding manipulation tool. When the switch is set to the "ON" state and the winding manipulation tool is manipulated to one side in the traveling posture in which the hook is placed in a predetermined place and the boom is luffed down, the boom is luffed up to adopt the working posture while the wire rope is unwound to prevent the hook from being hoisted. According to such a crane, manipulation of luffing up the boom while unwinding the wire rope is not required. Further, since no manipulative error can occur in connection with the transition from the traveling posture to the working posture, it is possible to prevent the hook from swinging and colliding with the traveling body or the like. Accordingly, it is possible to achieve improvement in manipulability and safety.

According to the crane of the present invention, the luffing-up speed of the boom is changed in accordance with the manipulation amount of the winding manipulation tool manipulated by the operator. According to such a crane, the luffing-up speed can be freely changed depending on the presence or absence of risk of interference or the like of the boom, so that it is possible to achieve further improvement in safety.

According to the crane of the present invention, the luffing-up speed of the boom is maintained constant regardless of the manipulation amount of the winding manipulation tool manipulated by the operator. According to such a crane, it is possible for the operator to concentrate on the transition from the traveling posture to the working posture without worrying about the luffing-up speed of the boom, so that it is possible to achieve further improvement in safety.

According to the crane of the present invention, when the boom is luffed up to a predetermined angle, the unwinding operation of the winch for unwinding the wire rope stops at the same time as the luffing-up operation of the boom stops. According to such a crane, each operation for transition from the traveling posture to the working posture is automatically stopped, so that it is possible to achieve further improvement in manipulability and safety.

According to the crane of the present invention, the crane includes the winding manipulation tool that allows giving an instruction on the operating state of the winch, and the switch that allows giving an instruction for switchover of the control mode for the manipulation of the winding manipulation tool. When the switch is set to the "ON" state and the winding manipulation tool is manipulated to the other side in the working posture in which the hook is placed in a predetermined place and the boom is luffed up, the boom is luffed down to adopt the traveling posture while the wire rope is wound to prevent the wire rope from slackening. According to such a crane, manipulation of luffing down the boom while winding the wire rope is not required. Further, since no manipulative error can occur in connection with the transition from the working posture to the traveling posture, it is possible to prevent the wire rope from slackening and coming off the sheave or the like. Accordingly, it is possible to achieve improvement in manipulability and safety.

According to the crane of the present invention, the luffing-down speed of the boom is changed in accordance with the manipulation amount of the winding manipulation tool manipulated by the operator. According to such a crane, the luffing-down speed can be freely changed depending on the presence or absence of risk of interference or the like of the boom, so that it is possible to achieve further improvement in safety.

According to the crane of the present invention, the luffing-down speed of the boom is maintained constant regardless of the manipulation amount of the winding manipulation tool manipulated by the operator. According to such a crane, it is possible for the operator to concentrate on the transition from the working posture to the traveling posture without worrying about the luffing-down speed of the boom, so that it is possible to achieve further improvement in safety.

According to the crane of the present invention, when the boom is luffed down to a predetermined angle, the winding operation of the winch for winding the wire rope stops at the same time as the luffing-down operation of the boom stops. According to such a crane, each operation for transition from the working posture to the traveling posture is automatically stopped, so that it is possible to achieve further improvement in manipulability and safety.

DESCRIPTION OF EMBODIMENT

Figure 1:
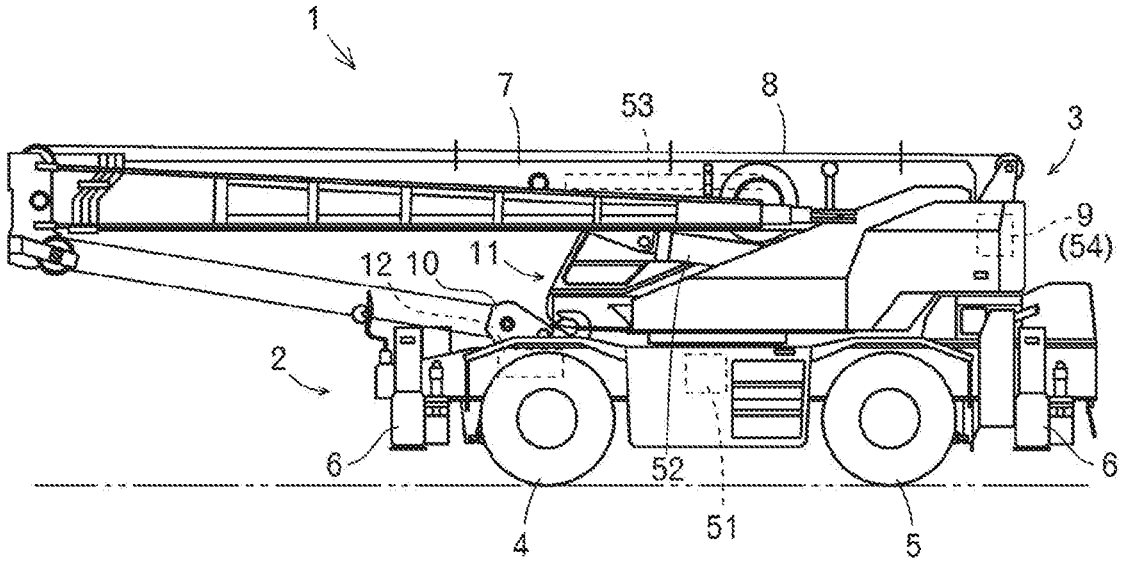
FIG. 1 illustrates a crane in a traveling posture.

The technical idea disclosed in the present specification is applicable not only to crane 1 described below but also to other cranes.

To begin with, the outline of crane 1 will be described with reference to FIGS. 1 to 3.

Crane 1 is mainly composed of traveling body 2 and swiveling body 3.

Traveling body 2 includes a pair of left and right front tires 4 and a pair of left and right rear tires 5. In addition, traveling body 2 is provided with outriggers 6 that are brought into contact with the ground for stabilization when carriage work for load W is performed. Further, traveling body 2 includes an actuator for driving these parts, an engine, a transmission, and the like. Note that, swiveling body 3 supported on traveling body 2 is swivelable by an actuator in traveling body 2.

Swiveling body 3 is provided with boom 7 protruding forward from the rear of the swiveling body. Accordingly, boom 7 is swivelable by an actuator. Further, boom 7 is capable of being luffed up and down by an actuator (see arrows A and B). Further, boom 7 is capable of being extended and retracted by an actuator (see arrows C and D). In addition, wire rope 8 is stretched in boom 7. Winch 9 around which wire rope 8 is wound is disposed on the base end side of boom 7, and hook 10 is hung by wire rope 8 on the leading end side of boom 7. Winch 9 is integrated with an actuator to allow winding and unwinding of wire rope 8. Thus, hook 10 is capable of being raised and lowered by the actuator (see arrows E and F). Note that, swiveling body 3 is provided with cabin 11 laterally with respect to boom 7. A handle and/or a gearshift required for traveling manipulation, and, swivel manipulation tool 21, luffing manipulation tool 23, extension/retraction manipulation tool 23, and winding manipulation tool 24, and/or the like required for carriage manipulation are disposed inside cabin 11. Further, push button 25 is disposed.

Figure 4:
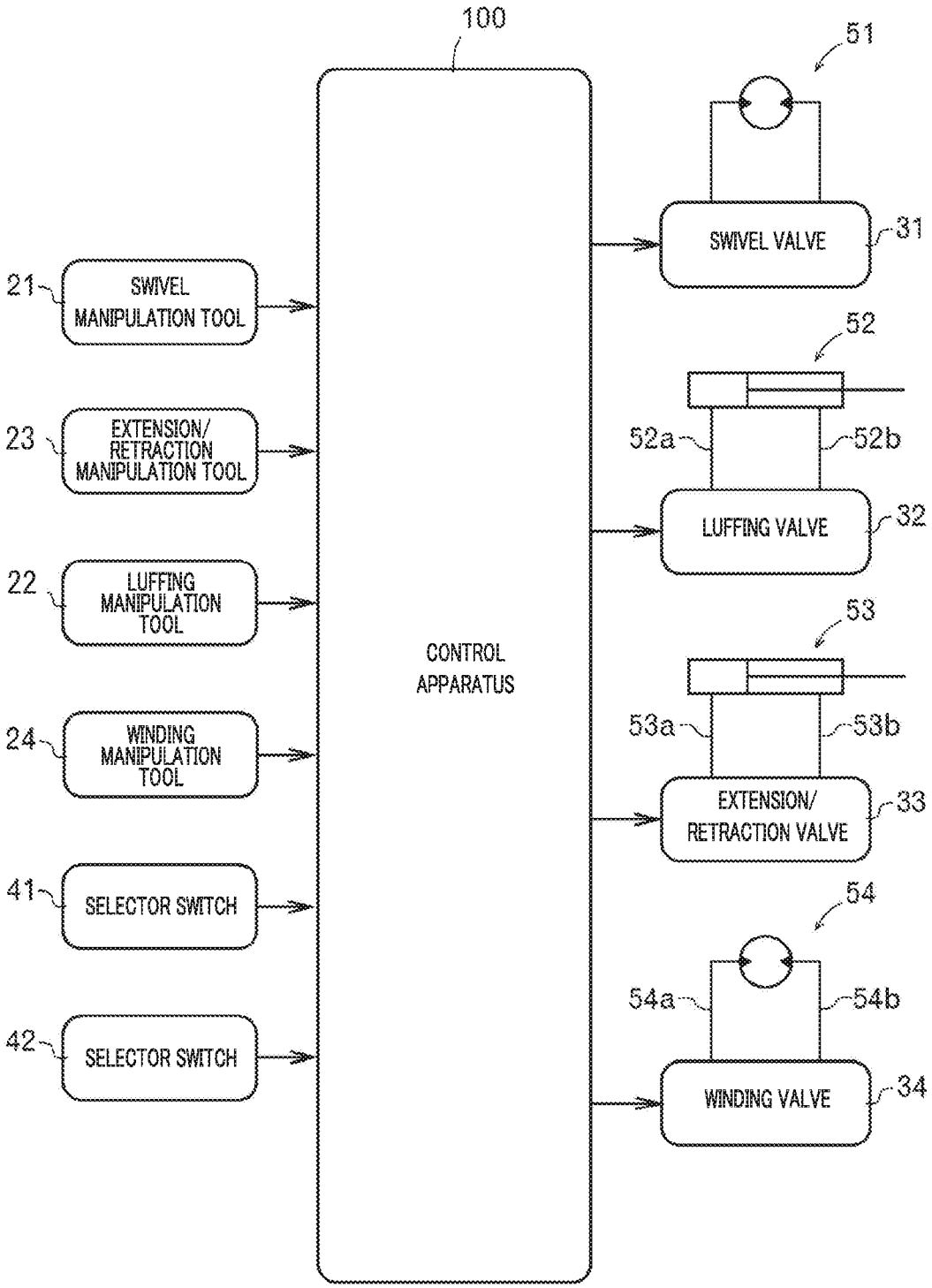
FIG. 4 illustrates a configuration of a control system.

Next, the outline of a control system will be described with reference to FIG. 4.

The control system is configured mainly by control apparatus 100. Various manipulation tools 21 to 24 are connected to control apparatus 100. Further, various valves 31 to 34 are connected to control apparatus 100.

As described above, boom 7 is swivelable by the actuator. In the present specification, such an actuator is defined as swivel motor 51. Swivel motor 51 is appropriately operated by swivel valve 31, which is an electromagnetic proportional switching valve. That is, swivel motor 51 is appropriately operated by swivel valve 31 switching the flow direction of hydraulic oil and/or adjusting the flow rate of the hydraulic oil. Note that, the swivel angle and/or the swivel speed of boom 7 are detected by a sensor (not illustrated). Control apparatus 100 can thus recognize the swivel angle and/or the swivel speed of boom 7.

Further, boom 7 is capable of being luffed up and down by the actuator as described above (see arrows A and B in FIG. 2). In the present specification, such an actuator is defined as luffing cylinder 52. Luffing cylinder 52 is appropriately operated by luffing valve 32, which is an electromagnetic proportional switching valve. That is, luffing cylinder 52 is appropriately operated by luffing valve 32 switching the flow direction of hydraulic oil and/or adjusting the flow rate of the hydraulic oil. Note that, luffing angle G (see FIG. 2) and/or the luffing speed of boom 7 are detected by a sensor (not illustrated). Control apparatus 100 can thus recognize luffing angle G and/or the luffing speed of boom 7.

Further, boom 7 is capable of being extended and retracted by the actuator as described above (see arrows C and D in FIG. 2). In the present specification, such an actuator is defined as extension/retraction cylinder 53. Extension/retraction cylinder 53 is appropriately operated by extension/retraction valve 33, which is an electromagnetic proportional switching valve. That is, extension/retraction cylinder 53 is appropriately operated by extension/retraction valve 33 switching the flow direction of hydraulic oil and/or adjusting the flow rate of the hydraulic oil. Note that, extension/retraction length H (see FIG. 2) and/or the extension/retraction speed of boom 7 are detected by a sensor (not illustrated). Control apparatus 100 can thus recognize extension/retraction length H and/or the extension/retraction speed of boom 7.

Further, hook 10 is capable of being raised and lowered by the actuator as described above (see arrows E and F in FIG. 2). In the present specification, such an actuator is defined as winding motor 54. Winding motor 54 is appropriately operated by winding valve 34, which is an electromagnetic proportional switching valve. That is, winding motor 54 is appropriately operated by winding valve 34 switching the flow direction of hydraulic oil and/or adjusting the flow rate of the hydraulic oil. Note that, suspension length L (see FIG. 2) and/or the raising/lowering speed of hook 10 are detected by a sensor (not illustrated). Control apparatus 100 can thus recognize suspension length L and/or the raising/lowering speed of hook 10.

With such a configuration, control apparatus 100 can control the actuators (51, 52, 53, and 54) via respective valves 31 to 34. However, it is expected that the actuators (51, 52, 53, and 54) are substituted by electric actuators in the near future. In this case, control apparatus 100 can directly control the electric actuators without respective valves 31 to 34.

In addition, various switches 41 and 42 are connected to control apparatus 100.

Selector switch 41 is attached to a bolt portion of push button 25 described above. An operator can instruct control apparatus 100 to switch the control mode for manipulation of winding manipulation tool 24 by pressing push button 25.

Figure 2:
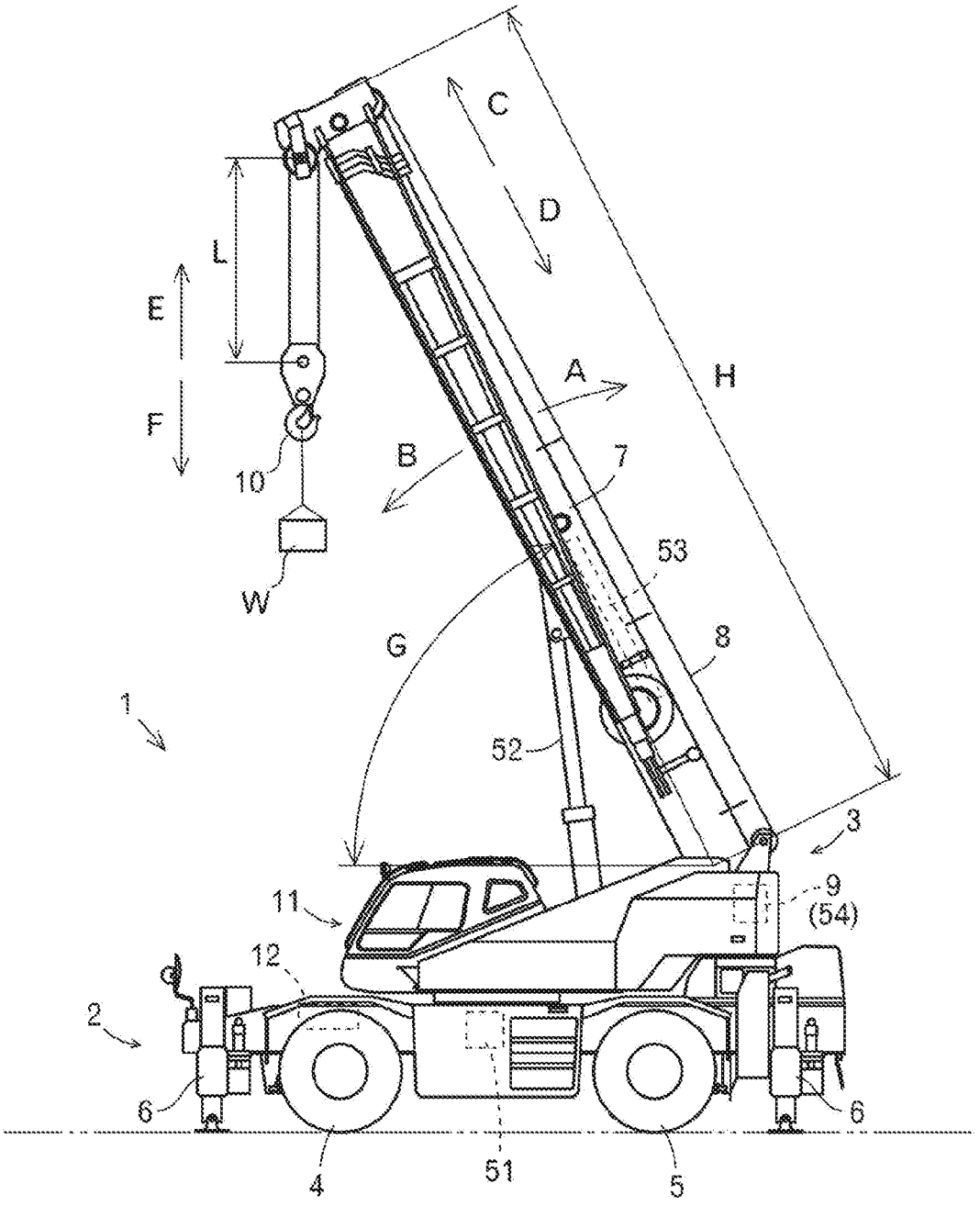
FIG. 2 illustrates a crane in a working posture.
Figure 3:
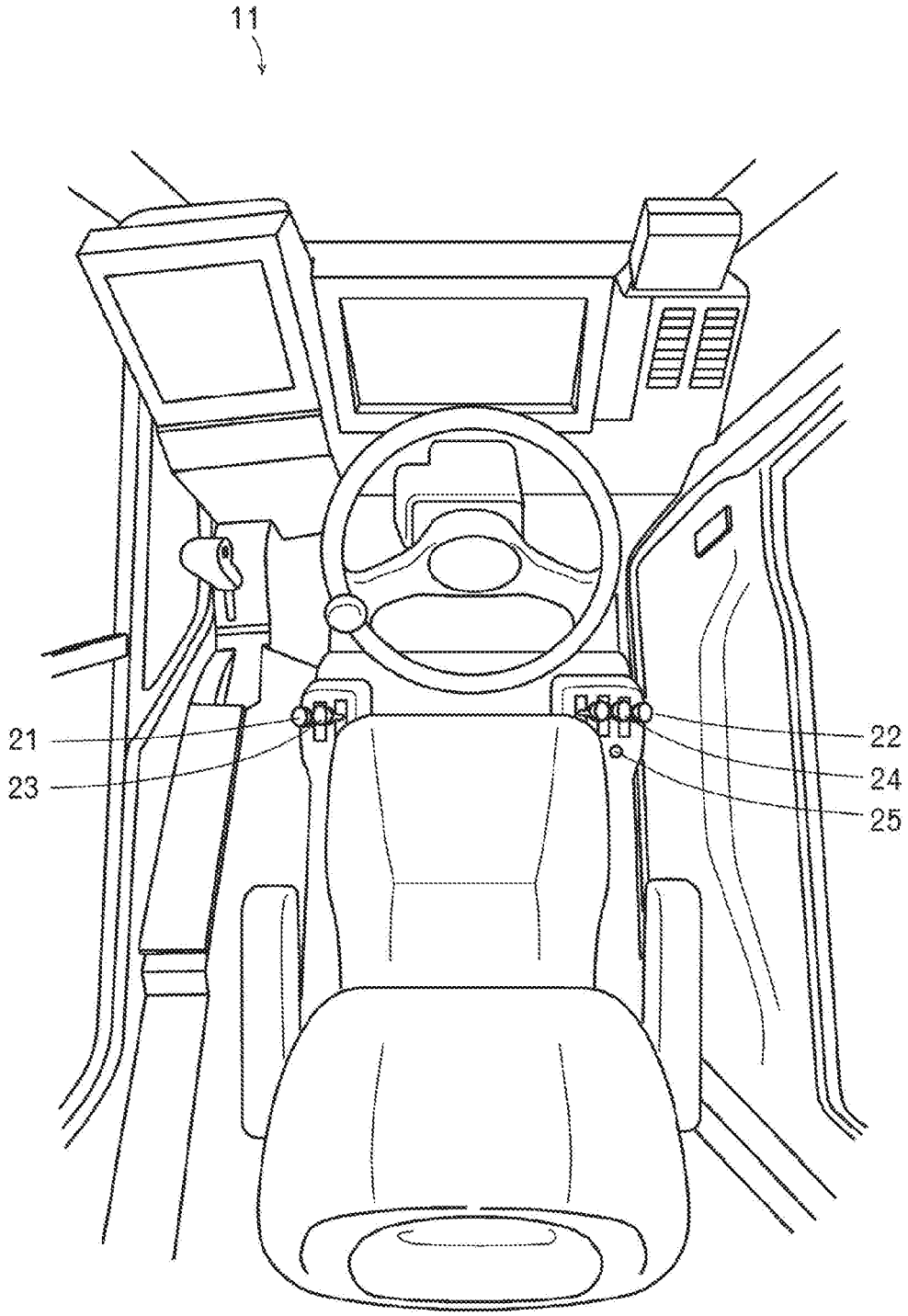
FIG. 3 illustrates the inside of a cabin.

Selector switch 42 is attached to hook base 12 of traveling body 2 (see FIGS. 1 and 2). Selector switch 42 is designed to be activated when hook 10 is placed on hook base 12. Control apparatus 100 can thus automatically recognize that hook 10 is placed on hook base 12. However, the control apparatus may be capable of automatically recognizing, without selector switch 42, that hook 10 is placed on hook base 12, when the posture of boom 7 (luffing angle G and extension/retraction length H; see FIG. 2) and the unwinding amount of wire rope 8 satisfy predetermined conditions.

Figure 5:
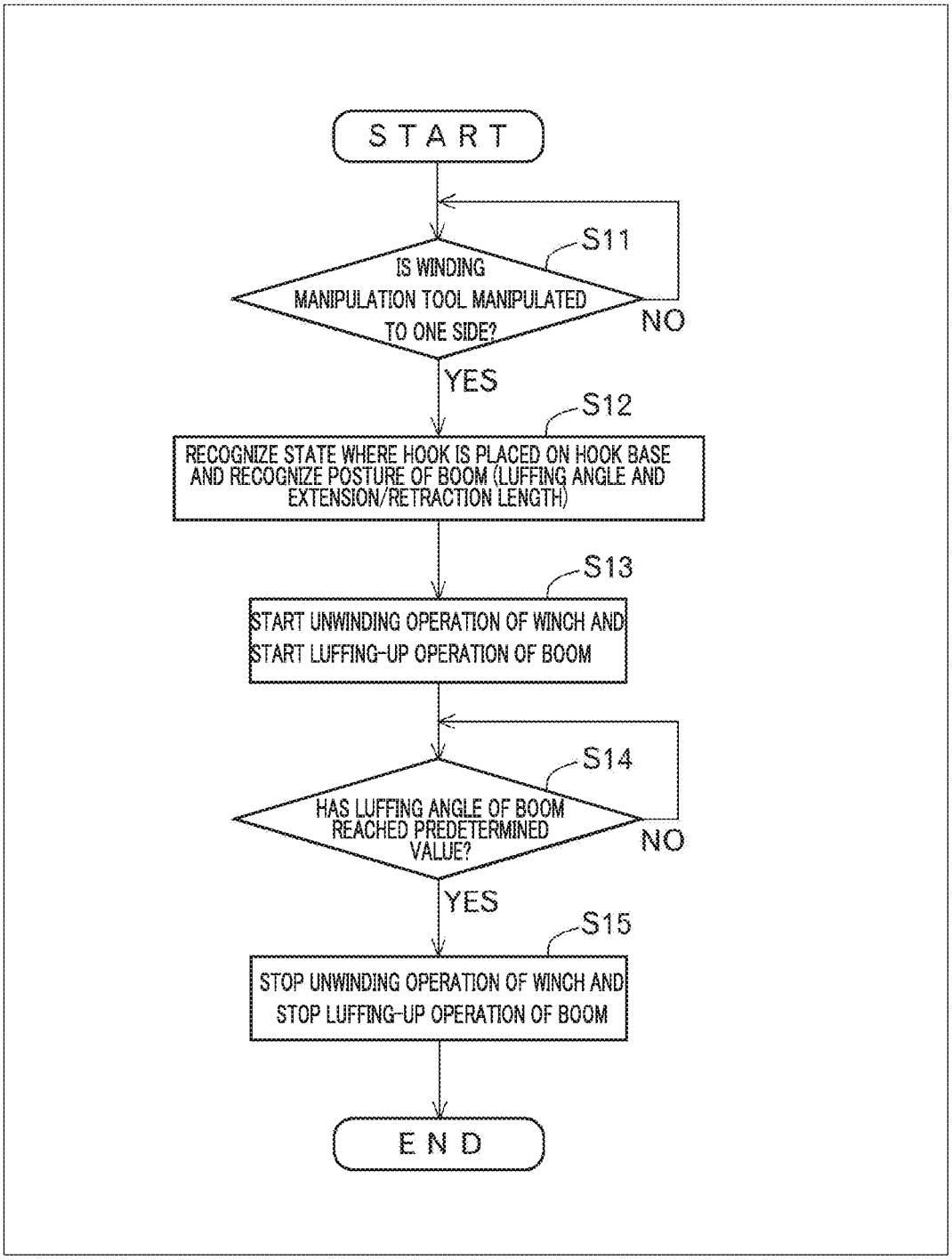
FIG. 5 illustrates a control mode for transition from a traveling posture to a working posture.
Figure 6:
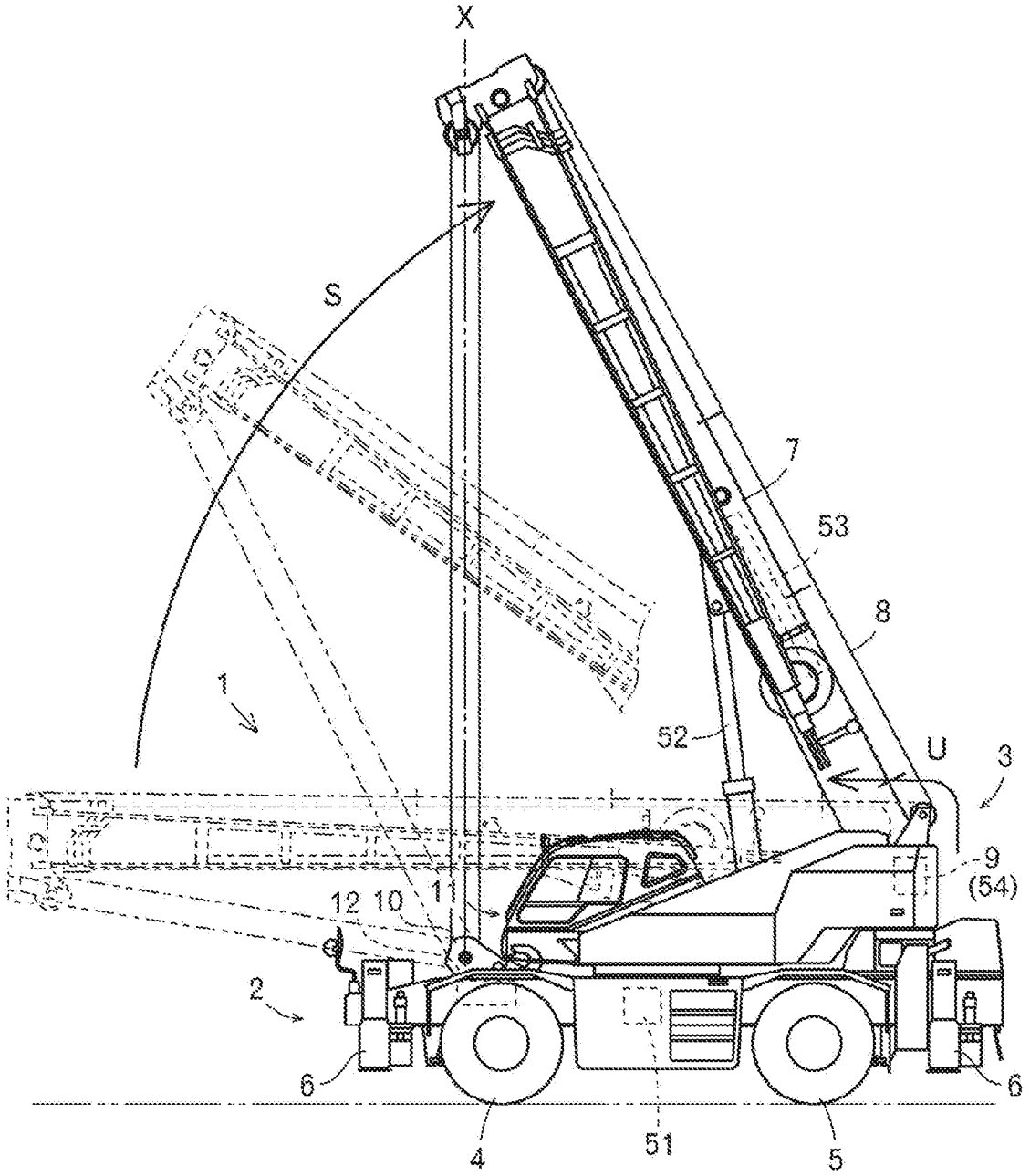
FIG. 6 illustrates a situation in which the traveling posture is transitioned to the working posture.

Next, the control mode for transition from the traveling posture to the working posture will be described with reference to FIGS. 5 and 6. Here, the description will be given on the assumption that the crane is in the traveling posture in which hook 10 is placed on hook base 12 and boom 7 is luffed down. Further, the description will be given on the assumption that push button 25 is pressed by the operator.

At step S11, control apparatus 100 determines whether or not winding manipulation tool 24 is manipulated to one side. When it is determined that winding manipulation tool 24 has been manipulated to one side, the control proceeds to step S12, and when it is determined that winding manipulation tool 24 has not been manipulated to one side, the control waits without proceeding.

At step S12, control apparatus 100 recognizes the state where hook 10 is placed on hook base 12. Control apparatus 100 also recognizes the posture of boom 7 (luffing angle G and extension/retraction length H; see FIG. 2). Thus, control apparatus 100 confirms the traveling posture in which hook 10 is placed on hook base 12 and boom 7 is luffed down. However, the traveling posture may also be confirmed by the fact that the posture of boom 7 and the unwinding amount of wire rope 8 satisfy predetermined conditions. Alternatively, the traveling posture may also be confirmed by the fact that push button 25 has been pressed.

At step S13, control apparatus 100 starts unwinding operation of winch 9 for unwinding wire rope 8. Specifically, control apparatus 100 controls winding valve 34 to supply hydraulic oil to winding motor 54 through pipe 54*b*. Then, winding motor 54 rotates in an other direction at an appropriate speed, and thus winch 9 rotates reversely at an appropriate speed. In other words, winch 9 performs the unwinding operation for unwinding wire rope 8 at an appropriate speed. Control apparatus 100 starts luffing-up operation of boom 7 at the same time. Specifically, control apparatus 100 controls luffing valve 32 to supply hydraulic fluid to luffing cylinder 52 through pipe 52*a*. Then, luffing cylinder 52 extends at an appropriate speed. That is, boom 7 performs the luffing-up operation at an appropriate speed. Thus, it is possible to luff up boom 7 while unwinding wire rope 8 to prevent hook 10 from being hoisted (see arrow U and arrow S in FIG. 6). Note that, the luffing-up speed of boom 7 is appropriately changed in accordance with the manipulation amount of winding manipulation tool 24 manipulated by the operator (the unwinding speed of wire rope 8 is also changed accordingly). This is because the changeability of the luffing-up speed depending on the presence or absence of risk of interference or the like of boom 7 contributes to further improvement of safety. However, the luffing-up speed of boom 7 may be a slow constant speed regardless of the manipulation amount of winding manipulation tool 24 manipulated by the operator. This is because it is conceivable that the operator can concentrate on the transition from the traveling posture to the working posture without worrying about the luffing-up speed of boom 7, so that such a slow constant speed also contributes to further improvement in safety. These may be switched by a separate switch. Note that, in both of the cases, the boom stops when winding manipulation tool 24 is returned to the neutral position.

At step S14, control apparatus 100 determines whether or not luffing angle G of boom 7 has reached a predetermined value. When it is determined that luffing angle G of boom 7 has reached the predetermined value, the control proceeds to step S15, and when it is determined that luffing angle G of boom 7 has not reached the predetermined value, the luffing-up operation of boom 7 is continued. Note that the "predetermined value" as used herein means an angle formed by boom 7 at a time when the leading end portion (top sheave or the like) of the boom is moved to a position vertically above hook 10 or hook base 12 (see imaginary line X in FIG. 6).

At step S15, control apparatus 100 stops the luffing-up operation of boom 7. Specifically, control apparatus 100 controls luffing valve 32 to cause the luffing valve to shut off the hydraulic oil that has been supplied to luffing cylinder 52. Then, the extension of luffing cylinder 52 is stopped. That is, the luffing-up operation of boom 7 is stopped. At the same time, control apparatus 100 stops the unwinding operation of winch 9 for unwinding wire rope 8. Specifically, control apparatus 100 controls winding valve 34 to cause the winding valve to shut off the hydraulic oil that has been supplied to winding motor 54. Then, the rotation of winding motor 54 is stopped, and thus the reverse rotation of winch 9 is stopped. That is, the unwinding operation of winch 9 for unwinding wire rope 8 is stopped. Thus, the transition from the traveling state to the working state is completed without hook 10 being hoisted (see FIG. 6). Thereafter, when the operator presses push button 25 again, the control mode is switched, so that the operator can hoist hook 10 (see arrow E in FIG. 2) by manipulating winding manipulation tool 24 to the one side.

In addition, although crane 1 implements such a control mode on condition that push button 25 is pressed, such a control mode may be implemented on condition of a detection signal detected by selector switch 42. This is because hook 10 is placed on hook base 12 on every occasion of the transition from the traveling state to the working state. In this case, when the transition to the working state is completed, the control mode is automatically switched, and hook 10 can be hoisted (see arrow E in FIG. 2) by manipulating winding manipulation tool 24 to the one side.

As described above, crane 1 of the present invention includes winding manipulation tool 24 that allows giving an instruction on the operating state of winch 9, and the switch (selector switch 41 or selector switch 42) that allows giving an instruction for switchover of the control mode for manipulation of winding manipulation tool 24. When the switch (41 or 42) is set to the "ON" state and winding manipulation tool 24 is manipulated to the one side in the traveling posture in which hook 10 is placed in a predetermined place (on hook base 12) and boom 7 is luffed down, boom 7 is luffed up to adopt the working posture while wire rope 8 is unwound to prevent hook 10 from being hoisted. According to such a crane 1, manipulation of luffing up boom 7 while unwinding wire rope 8 is not required. Further, since no manipulative error can occur in connection with the transition from the traveling posture to the working posture, it is possible to prevent hook 10 from swinging and colliding with traveling body 2 or the like. Accordingly, it is possible to achieve improvement in manipulability and safety.

Furthermore, in crane 1 of the present invention, the luffing-up speed of boom 7 is changed in accordance with the manipulation amount of winding manipulation tool 24 manipulated by the operator. According to such a crane 1, the luffing-up speed can be freely changed depending on the presence or absence of risk of interference or the like of boom 7, so that it is possible to achieve further improvement in safety. Alternatively, in crane 1 of the present invention, the luffing-up speed of boom 7 is maintained constant regardless of the manipulation amount of winding manipulation tool 24 manipulated by the operator. According to such a crane 1, it is possible for the operator to concentrate on the transition from the traveling posture to the working posture without worrying about the luffing-up speed of boom 7, so that it is possible to achieve further improvement in safety.

Further, when boom 7 is luffed up to a predetermined angle, the unwinding operation of winch 9 for unwinding wire rope 8 stops at the same time as the luffing-up operation of boom 7 stops in crane 1 of the present invention. According to such a crane 1, each operation for transition from the traveling posture to the working posture is automatically stopped, so that it is possible to achieve further improvement in manipulability and safety.

Figure 7:
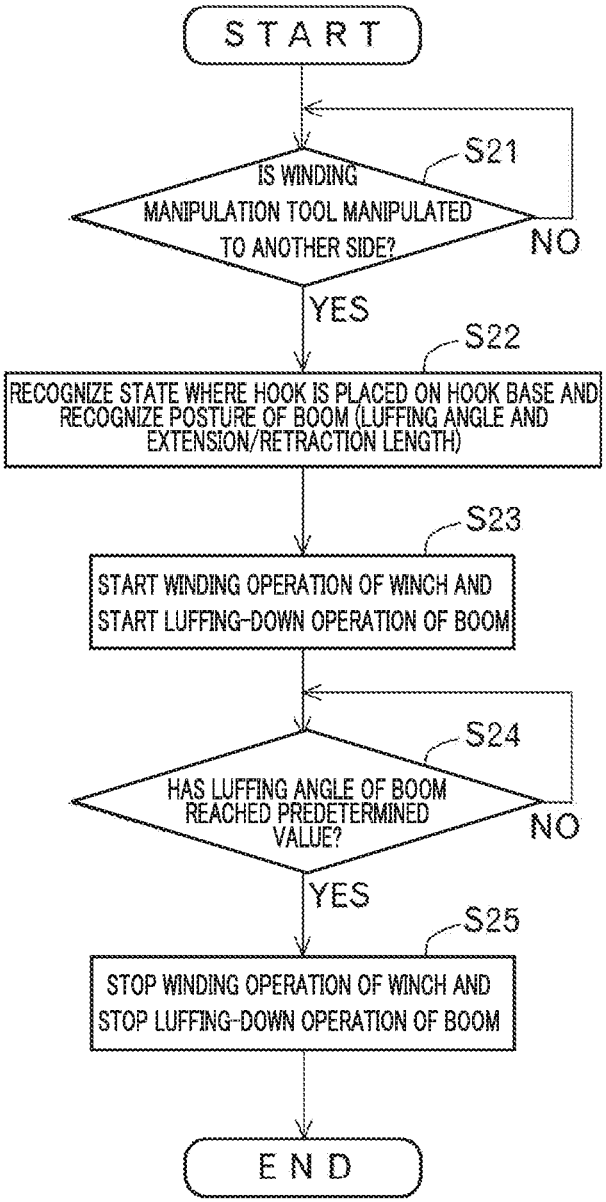
FIG. 7 illustrates a control mode for the transition from the working posture to the traveling posture.
Figure 8:
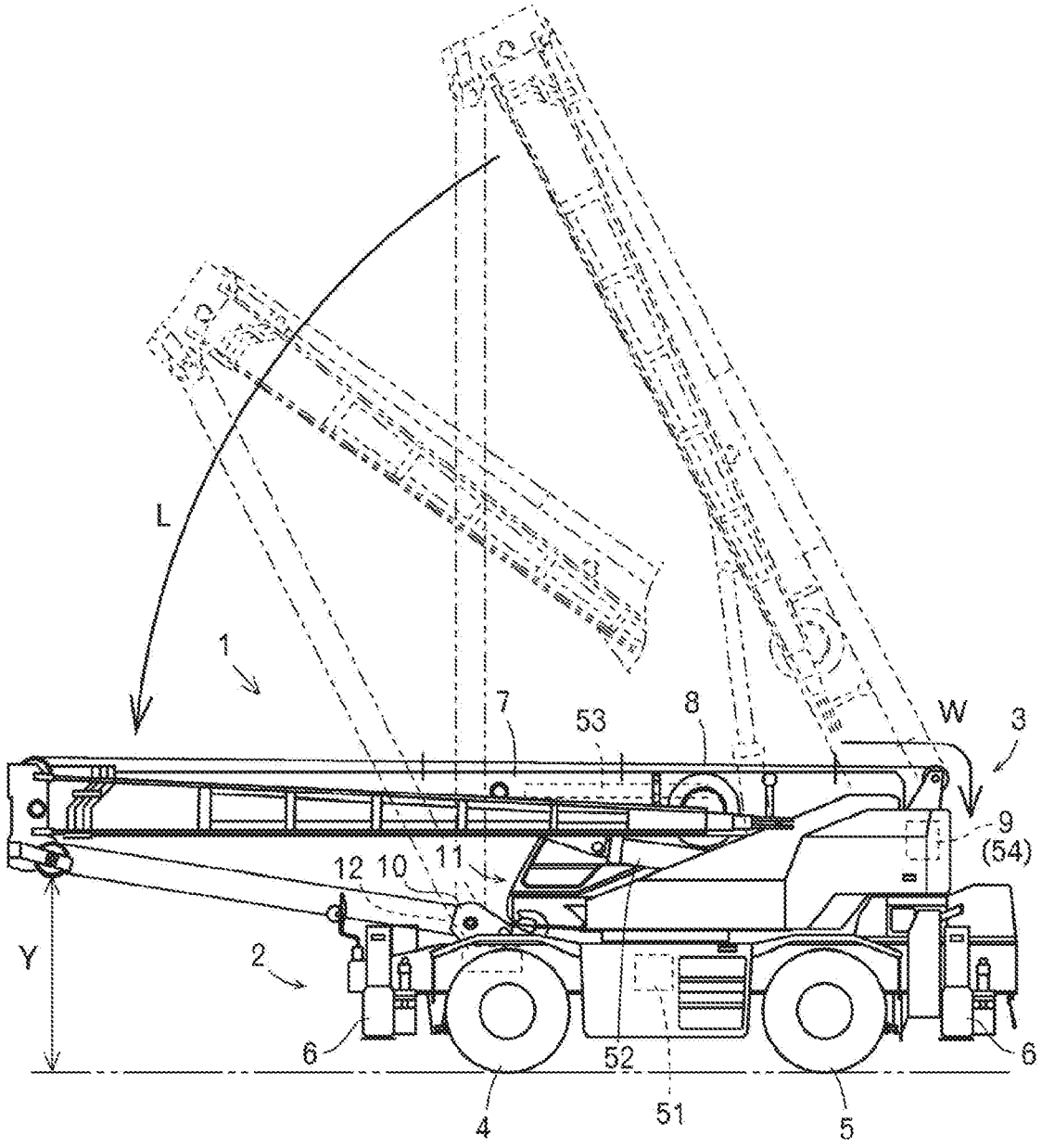
FIG. 8 illustrates a situation in which the working posture is transitioned to the traveling posture.

Next, a control mode for transition from the working posture to the traveling posture will be described with reference to FIGS. 7 and 8. Here, the description will be given on the assumption that the crane is in the working posture in which hook 10 is placed on hook base 12 and boom 7 is luffed up. Further, the description will be given on the assumption that push button 25 is pressed by the operator.

At step S21, control apparatus 100 determines whether or not winding manipulation tool 24 is manipulated to an other side. When it is determined that winding manipulation tool 24 has been manipulated to the other side, the control proceeds to step S22, and when it is determined that winding manipulation tool 24 has not been manipulated to the other side, the control waits without proceeding.

At step S22, control apparatus 100 recognizes the state where hook 10 is placed on hook base 12. Control apparatus 100 also recognizes the posture of boom 7 (luffing angle G and extension/retraction length H; see FIG. 2). Thus, control apparatus 100 confirms the working posture in which hook 10 is placed on hook base 12 and boom 7 is luffed up. However, the working posture may also be confirmed by the fact that the posture of boom 7 and the unwinding amount of wire rope 8 satisfy predetermined conditions. Alternatively, the working posture may also be confirmed by the fact that push button 25 has been pressed.

At step S23, control apparatus 100 starts winding operation of winch 9 for winding wire rope 8. Specifically, control apparatus 100 controls winding valve 34 to supply hydraulic oil to winding motor 54 through pipe 54*a*. Then, winding motor 54 rotates in one direction at an appropriate speed, and thus winch 9 rotates forward at an appropriate speed. In other words, winch 9 performs the winding operation for winding wire rope 8 at an appropriate speed. Control apparatus 100 starts luffing-down operation of boom 7 at the same time. Specifically, control apparatus 100 controls luffing valve 32 to supply hydraulic fluid to luffing cylinder 52 through pipe 52*b*. Then, luffing cylinder 52 retracts at an appropriate speed. That is, boom 7 performs the luffing-down operation at an appropriate speed. Thus, it is possible to luff down boom 7 while winding wire rope 8 to prevent wire rope 8 from slackening (see arrow W and arrow L in FIG. 8). Note that, the luffing-down speed of boom 7 is changed in accordance with the manipulation amount of winding manipulation tool 24 manipulated by the operator (the winding speed of wire rope 8 is also changed accordingly). This is because the changeability of the luffing-down speed depending on the presence or absence of risk of interference or the like of boom 7 contributes to further improvement of safety. However, the luffing-down speed of boom 7 may be a slow constant speed regardless of the manipulation amount of winding manipulation tool 24 manipulated by the operator. This is because it is conceivable that the operator can concentrate on the transition from the working posture to the traveling posture without worrying about the luffing-down speed of boom 7, so that such a slow constant speed contributes to further improvement in safety. These may be switched by a separate switch. Note that, in both of the cases, the boom stops when winding manipulation tool 24 is returned to the neutral position.

At step S24, control apparatus 100 determines whether or not luffing angle G of boom 7 has reached a predetermined value. When it is determined that luffing angle G of boom 7 has reached the predetermined value, the control proceeds to Step S25, and when it is determined that luffing angle G of boom 7 has not reached the predetermined value, the luffing-down operation of boom 7 is continued. Note that the "predetermined value" as used herein means an angle formed by boom 7 at a time when the leading end portion (top sheave or the like) of the boom is moved to the lowest position (see height Y in FIG. 8).

At step S25, control apparatus 100 stops the luffing-down operation of boom 7. Specifically, control apparatus 100 controls luffing valve 32 to cause the luffing valve to shut off the hydraulic oil that has been supplied to luffing cylinder 52. Then, the retraction of luffing cylinder 52 is stopped. That is, the luffing-down operation of boom 7 is stopped. At the same time, control apparatus 100 stops the winding operation of winch 9 for winding wire rope 8. Specifically, control apparatus 100 controls winding valve 34 to cause the winding valve to shut off the hydraulic oil that has been supplied to winding motor 54. Then, the rotation of winding motor 54 is stopped, and thus the forward rotation of winch 9 is stopped. That is, the winding operation of winch 9 for winding wire rope 8 is stopped. Thus, the transition from the working state to the traveling state is completed without any slackening of wire rope 8 (see FIG. 8).

In addition, although crane 1 implements such a control mode on condition that push button 25 is pressed, such a control mode may be implemented on condition of a detection signal detected by selector switch 42. This is because hook 10 is placed on hook base 12 on every occasion of the transition from the working state to the traveling state.

As described above, crane 1 of the present invention includes winding manipulation tool 24 that allows giving an instruction on the operating state of winch 9, and the switch (selector switch 41 or selector switch 42) that allows giving an instruction for switchover of the control mode for manipulation of winding manipulation tool 24. When the switch (41 or 42) is set to the "ON" state and winding manipulation tool 24 is manipulated to the other side in the working posture in which hook 10 is placed in a predetermined place (on hook base 12) and boom 7 is luffed up, boom 7 is luffed down to adopt the traveling posture while wire rope 8 is wound to prevent wire rope 8 from slackening. According to such a crane 1, manipulation of luffing down boom 7 while winding wire rope 8 is not required. Further, since no manipulative error can occur in connection with the transition from the traveling posture to the working posture, it is possible to prevent wire rope 8 from slacking and coming off the sheave or the like. Accordingly, it is possible to achieve improvement in manipulability and safety.

Furthermore, in crane 1 of the present invention, the luffing-down speed of boom 7 is changed in accordance with the manipulation amount of winding manipulation tool 24 manipulated by the operator. According to such a crane 1, the luffing-down speed can be freely changed depending on the presence or absence of risk of interference or the like of boom 7, so that it is possible to achieve further improvement in safety. Alternatively, in crane 1 of the present invention, the luffing-down speed of boom 7 is maintained constant regardless of the manipulation amount of winding manipulation tool 24 manipulated by the operator. According to such a crane 1, it is possible for the operator to concentrate on the transition from the working posture to the traveling posture without worrying about the luffing-down speed of boom 7, so that it is possible to achieve further improvement in safety.

Further, when boom 7 is luffed down to a predetermined angle, the winding operation of winch 9 for winding wire rope 8 stops at the same time as the luffing-down operation of boom 7 stops in crane 1 of the present invention. According to such a crane 1, each operation for transition from the working posture to the traveling posture is automatically stopped, so that it is possible to achieve further improvement in manipulability and safety.

Meanwhile, in the working posture in which hook 10 is hoisted, the following control mode is carried out when the operator presses push button 25.

Figure 9:
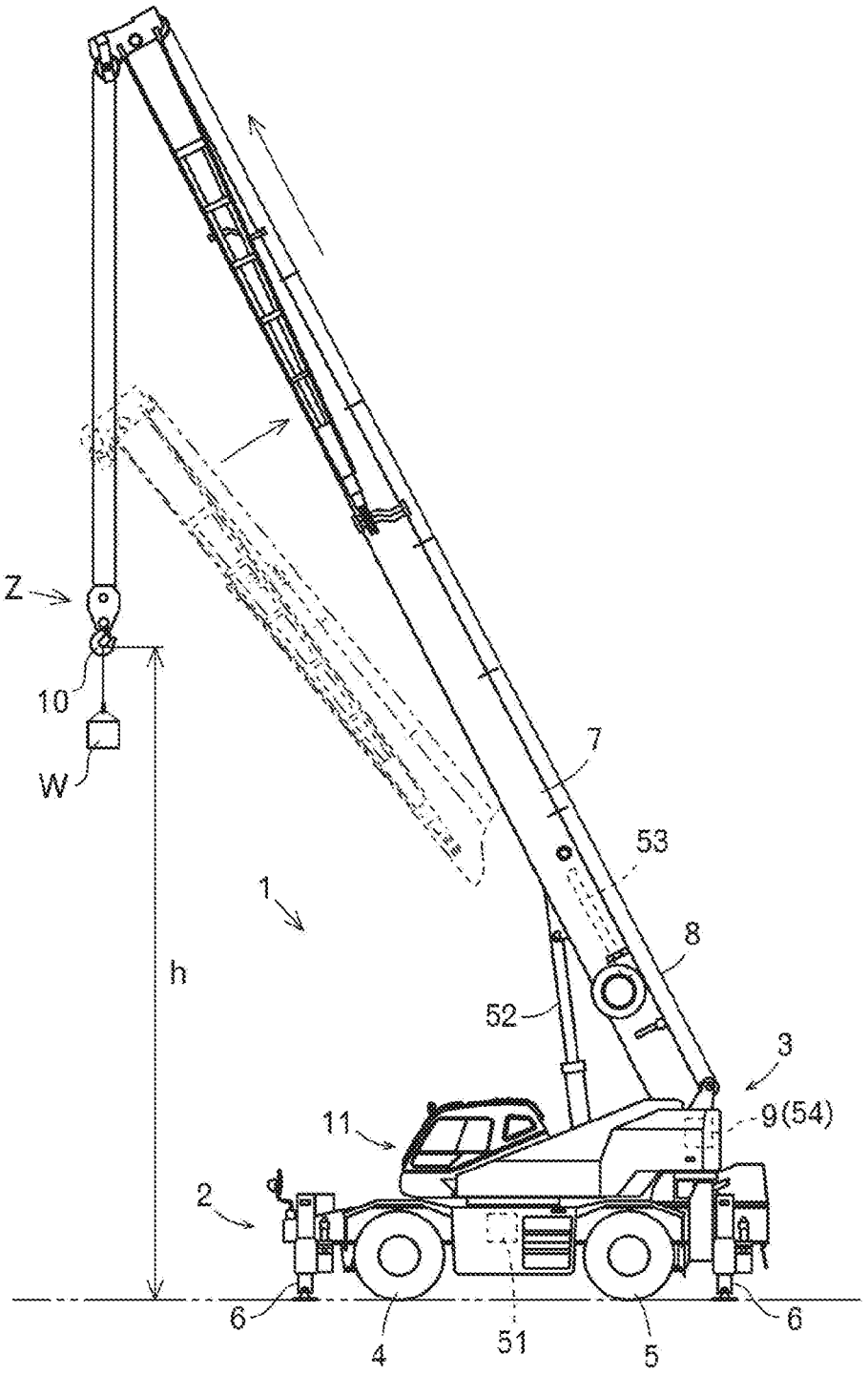
FIG. 9 illustrates a situation in which the posture is changed by luffing-up operation and extension operation of a boom.

To begin with, a case where winding manipulation tool 24 is manipulated to the one side will be described with reference to FIG. 9.

In this case, control apparatus 100 starts the unwinding operation of winch 9 for unwinding wire rope 8. Specifically, control apparatus 100 controls winding valve 34 to supply hydraulic oil to winding motor 54 through pipe 54*b*. Then, winding motor 54 rotates in the other direction at an appropriate speed, and thus winch 9 rotates reversely at an appropriate speed. In other words, winch 9 performs the unwinding operation for unwinding wire rope 8 at an appropriate speed. Control apparatus 100 starts luffing-up operation of boom 7 at the same time. Specifically, control apparatus 100 controls luffing valve 32 to supply hydraulic fluid to luffing cylinder 52 through pipe 52*a*. Then, luffing cylinder 52 extends at an appropriate speed. That is, boom 7 performs the luffing-up operation at an appropriate speed. Further, control apparatus 100 starts extension operation of boom 7 at the same time. Specifically, control apparatus 100 controls extension/retraction valve 33 to supply hydraulic fluid to extension/retraction cylinder 53 through pipe 53*a*. Then, extension/retraction cylinder 53 extends at an appropriate speed. That is, boom 7 performs the extension operation at an appropriate speed. Thus, the posture of boom 7 can be changed by the luffing-up operation and the extension operation of boom 7 while keeping lifting height h of hook 10. Note that, the position of hook 10 is maintained (see position Z in FIG. 9) such that the hook does not move in the horizontal direction or in the upper-lower direction. This is achieved by adjusting the speed at which wire rope 8 is unwound, the speed at which boom 7 is luffed up, and the speed at which boom 7 extends. In addition, the speed at which wire rope 8 is unwound, the speed at which boom 7 is luffed up, and the speed at which boom 7 extends can be changed by manipulation of winding manipulation tool 24, with the association with one another being maintained. Thus, the speed at which the posture of boom 7 changes can be changed by the manipulation of winding manipulation tool 24.

As described above, crane 1 of the present invention includes winding manipulation tool 24 that allows giving an instruction on the operating state of winch 9, and the switch (selector switch 41) that allows instructing that lifting height h of hook 10 be kept. When winding manipulation tool 24 is manipulated to the one side when the switch (41) is in the "ON" state, boom 7 is luffed up and extended to change the posture of boom 7 while wire rope 8 is unwound to keep lifting height h of hook 10. According to such a crane 1, manipulation of luffing up and extending boom 7 while unwinding wire rope 8 at the same time is not required. Further, since no manipulative error can occur in connection with the manipulation of luffing up and extending boom 7, it is possible to prevent hook 10 or load W from colliding with the side surface of a building or the like. Accordingly, it is possible to achieve improvement in manipulability and safety.

Figure 10:
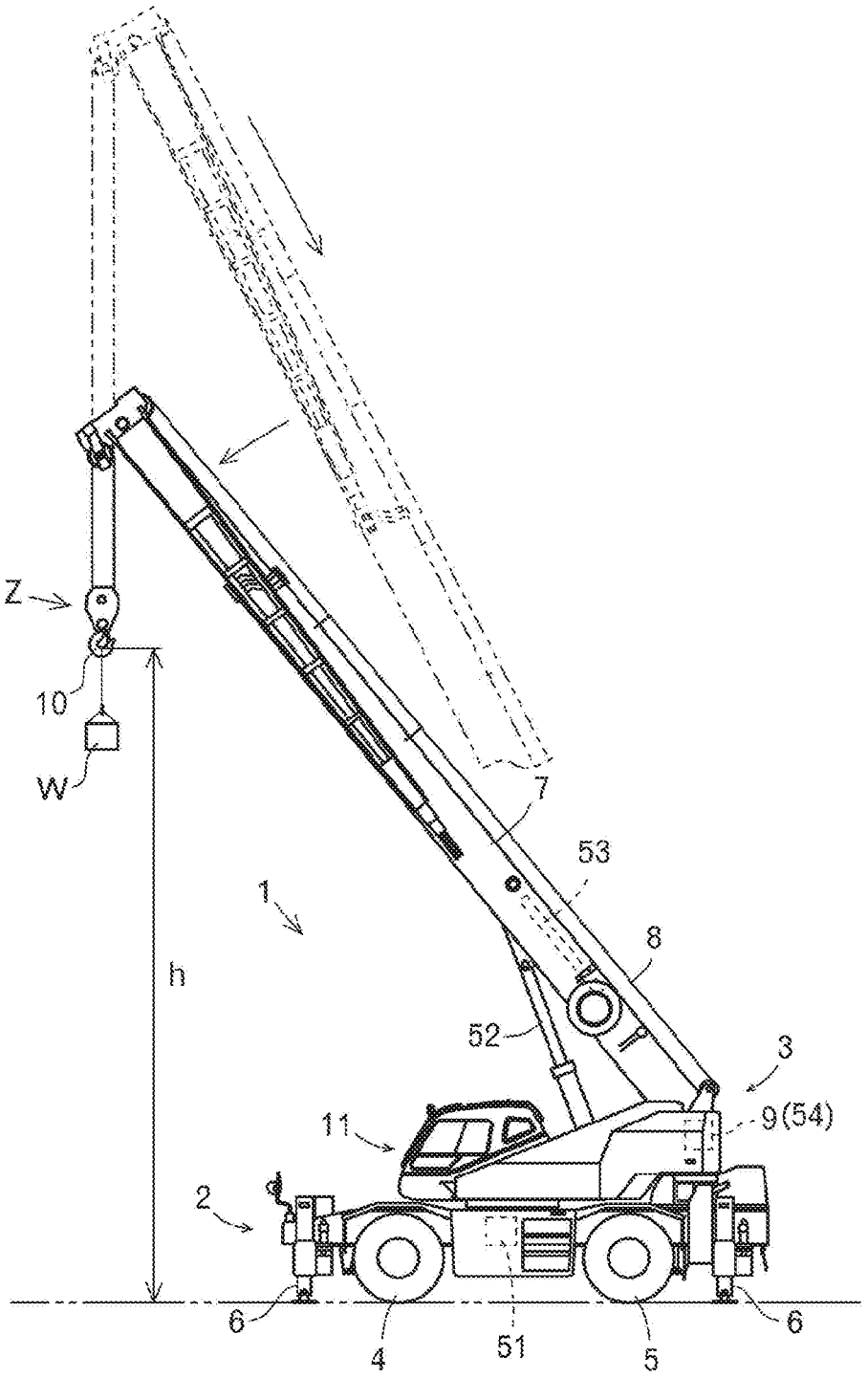
FIG. 10 illustrates a situation in which the posture is changed by luffing-down operation and retraction operation of the boom.

Next, a case where winding manipulation tool 24 is manipulated to the other side will be described with reference to FIG. 10.

In this case, control apparatus 100 starts the winding operation of winch 9 for winding wire rope 8. Specifically, control apparatus 100 controls winding valve 34 to supply hydraulic oil to winding motor 54 through pipe 54*a*. Then, winding motor 54 rotates in the one direction at an appropriate speed, and thus winch 9 rotates forward at an appropriate speed. In other words, winch 9 performs the winding operation for winding wire rope 8 at an appropriate speed. Control apparatus 100 starts luffing-down operation of boom 7 at the same time. Specifically, control apparatus 100 controls luffing valve 32 to supply hydraulic fluid to luffing cylinder 52 through pipe 52*b*. Then, luffing cylinder 52 retracts at an appropriate speed. That is, boom 7 performs the luffing-down operation at an appropriate speed. Further, control apparatus 100 starts retraction operation of boom 7 at the same time. Specifically, control apparatus 100 controls extension/retraction valve 33 to supply hydraulic fluid to extension/retraction cylinder 53 through pipe 53*b*. Then, extension/retraction cylinder 53 retracts at an appropriate speed. That is, boom 7 performs the retraction operation at an appropriate speed. Thus, the posture of boom 7 can be changed by the luffing-down operation and the retraction operation of boom 7 while keeping lifting height h of hook 10. Note that, the position of hook 10 is maintained (see position Z in FIG. 10) such that the hook does not move in the horizontal direction or in the upper-lower direction. This is achieved by adjusting the speed at which wire rope 8 is wound, the speed at which boom 7 is luffed down, and the speed at which boom 7 retracts. In addition, the speed at which wire rope 8 is wound, the speed at which boom 7 is luffed down, and the speed at which boom 7 retracts can be changed by manipulation of winding manipulation tool 24, with the association with one another being maintained. Thus, the postural change speed of boom 7 can be changed by the manipulation of winding manipulation tool 24.

As described above, crane 1 of the present invention includes winding manipulation tool 24 that allows giving an instruction on the operating state of winch 9, and the switch (selector switch 41) that allows instructing that lifting height h of hook 10 be kept. When winding manipulation tool 24 is manipulated to the other side when the switch (41) is in the "ON" state, boom 7 is luffed down and retracted to change the posture of boom 7 while wire rope 8 is wound to keep lifting height h of hook 10. According to such a crane 1, manipulation of luffing down and retracting boom 7 while winding wire rope 8 at the same time is not required. Further, since no manipulative error can occur in connection with the manipulation of luffing down and retracting boom 7, it is possible to prevent hook 10 or load W from colliding with the side surface of a building or the like. Accordingly, it is possible to achieve improvement in manipulability and safety.

Figure 11:
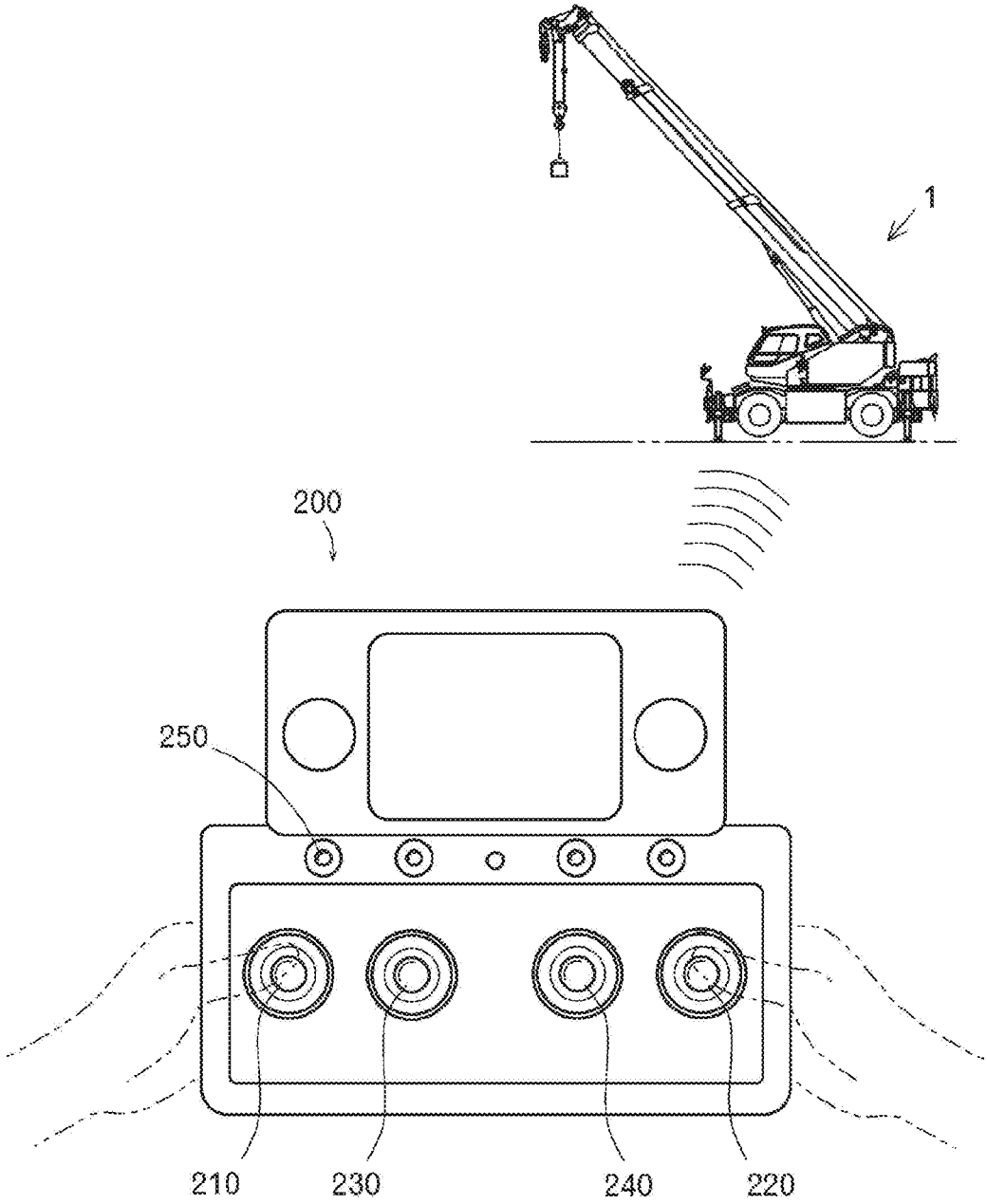
FIG. 11 illustrates a remote manipulation terminal.

Next, remote manipulation terminal 200 will be described with reference to FIG. 11. However, remote manipulation terminal 200 is an example of a remote manipulation terminal and the remote manipulation terminal is not limited this example.

Remote manipulation terminal 200 is provided with swivel manipulation tool 210, luffing manipulation tool 220, extension/retraction manipulation tool 230, winding manipulation tool 240, and/or the like required for carriage manipulation. Remote manipulation terminal 200 is also provided with push button 250.

When the operator manipulates swivel manipulation tool 210, crane 1 operates in the same manner as in the above-described case where swivel manipulation tool 21 is manipulated. Further, when the operator manipulates luffing manipulation tool 220, the crane operates in the same manner as in the above-described case where luffing manipulation tool 22 is manipulated. Further, when the operator manipulates extension/retraction manipulation tool 230, the crane operates in the same manner as in the above-described case where extension/retraction manipulation tool 23 is manipulated. When the operator manipulates winding manipulation tool 240, the crane operates in the same manner as in the above-described case where winding manipulation tool 24 is manipulated. In addition, when the operator presses push button 250, crane 1 operates in the same manner as in the above-described case where push button 25 is manipulated. As is understood, the technical idea disclosed in the present specification can be realized also with remote manipulation terminal 200.

Lastly, crane 1 of the present invention may be configured to include a joystick instead of manipulation tools 21 to 23, and a switch or the like instead of winding manipulation tool 24. Additionally or alternatively, remote manipulation terminal 200 may be configured to include a joystick instead of manipulation tools 210, 220, and 230, and a switch or the like instead of winding manipulation tool 240. According to such a crane, the operator can manipulate load W as a manipulation target rather than manipulate boom 7 or winch 9 as manipulation targets. In this case, an instruction on the moving direction of load W is directly given, and boom 7 and winch 9 are operated to carry out the instruction.

In addition, boom 7 and winch 9 are targets to be controlled in the invention according to the present application. Here, in a case where boom 7 is, at the leading end portion, provided with a jib and this jib is capable of being luffed up and down, the jib instead of boom 7 may be luffed up or down in first to eighth inventions. That is, the jib is included in boom 7 as a component of boom 7.

INDUSTRIAL APPLICABILITY

The present invention is applicable to cranes. Specifically, the present invention is applicable to a crane which achieves improvement in manipulability and safety.

REFERENCE SIGNS LIST

1 Crane
2 Traveling body
3 Swiveling body
7 Boom
8 Wire rope
9 Winch
10 Hook
12 Hook base (predetermined place)
21 Swivel manipulation tool
22 Luffing manipulation tool
23 Extension/retraction manipulation tool
24 Winding manipulation tool
25 Push button
31 Swivel valve
32 Luffing valve
33 Extension/retraction valve
34 Winding valve
41 Selector switch (switch)
42 Selector switch (switch)
51 Swivel motor
52 Luffing cylinder
53 Extension/retraction cylinder
54 Winding motor
100 Control apparatus
h Lifting height

The invention claimed is:

1. A crane provided with a boom, a wire rope, a winch, and a hook, the boom being capable of being luffed up and down, extended, and retracted, the wire rope being configured to hang from the boom, the winch being configured to wind or unwind the wire rope, the hook being configured to be raised or lowered by the wire rope wound or unwound, the crane comprising:

a winding manipulation tool that allows giving an instruction on an operating state of the winch;

a control apparatus that controls luffing-up operation and luffing-down operation of the boom and unwinding operation and winding operation of the winch based on an operation manipulated by an operator; and a switch that allows giving an instruction for switchover of a control mode for manipulation of the winding manipulation tool, wherein, the switch includes a selector switch attached to a hook base and configured to be activated when the hook is placed on a predetermined place on the hook base, when the crane is in a traveling posture in which the boom is luffed down and the switch is set to an "ON" state based on the selector switch detecting that the hook is placed on the predetermined place, the control apparatus controls the luffing-up operation of the boom and the unwinding operation of the winch to prevent the hook from being hoisted based on an operation to instruct an unwinding of the wire rope in the winding manipulation tool.

2. The crane according to claim 1, wherein the control apparatus changes a luffing-up speed of the boom in accordance with a manipulation amount of the winding manipulation tool manipulated by the operator.

3. The crane according to claim 1, wherein the control apparatus maintains a luffing-up speed of the boom constant regardless of a manipulation amount of the winding manipulation tool manipulated by the operator.

4. The crane according to claim 1, wherein, when the boom is luffed up to a predetermined angle, the control apparatus stops the unwinding operation of the winch for unwinding the wire rope at a same time as the luffing-up operation of the boom stops.

5. A crane provided with a boom, a wire rope, a winch, and a hook, the boom being capable of being luffed up and down, extended, and retracted, the wire rope being configured to hang from the boom, the winch being configured to wind or unwind the wire rope, the hook being configured to be raised or lowered by the wire rope wound or unwound, the crane comprising:

a winding manipulation tool that allows giving an instruction on an operating state of the winch;

a control apparatus that controls luffing-up operation and luffing-down operation of the boom and unwinding operation and winding operation of the winch based on an operation manipulated by an operator; and a switch that allows giving an instruction for switchover of a control mode for manipulation of the winding manipulation tool, wherein, the switch includes a selector switch attached to a hook base and configured to be activated when the hook is placed on a predetermined place on the hook base, when the crane is in a working posture in which the boom is luffed up and the switch is set to an "ON" state predetermined place and the boom is luffed up based on the selector switch detecting that the hook is placed on the predetermined place, the control apparats controls the luffing-down operation of the boom and the winding operation of the winch to prevent the wire rope from slackening based on an operation to instruct a winding of the wire rope in the winding manipulation tool.

6. The crane according to claim 5, wherein the control apparatus changes a luffing-down speed of the boom in accordance with a manipulation amount of the winding manipulation tool manipulated by the operator.

7. The crane according to claim 5, wherein the control apparatus maintains a luffing-down speed of the boom constant regardless of a manipulation amount of the winding manipulation tool manipulated by the operator.

8. The crane according to claim 5, wherein when the boom is luffed down to a predetermined angle, the control apparatus stops the winding operation of the winch for winding the wire rope at a same time as the luffing-down operation of the boom stops.

* * * * *